United States Patent [19]

Blaskowski

[11] Patent Number: 4,480,559

[45] Date of Patent: Nov. 6, 1984

[54] COAL AND CHAR BURNER

[75] Inventor: Henry J. Blaskowski, Avon, Conn.

[73] Assignee: Combustion Engineering, Inc., Windsor, Conn.

[21] Appl. No.: 456,479

[22] Filed: Jan. 7, 1983

[51] Int. Cl.[3] ..... F23D 1/00

[52] U.S. Cl. ..... 110/347; 110/263; 110/265; 431/2; 431/284

[58] Field of Search ..... 110/263, 264, 265, 347; 431/9, 115, 181, 187, 284, 2; 239/422; 60/39, 49; 417/177, 179

[56] References Cited

U.S. PATENT DOCUMENTS

| | | | |
|---|---|---|---|
| 2,971,480 | 2/1961 | Sage | 110/265 |
| 4,249,470 | 2/1981 | Vatsky | 431/284 X |
| 4,367,680 | 1/1983 | Adrian | 110/347 |
| 4,422,391 | 12/1983 | Izuha et al. | 110/347 |

FOREIGN PATENT DOCUMENTS

| | | | |
|---|---|---|---|
| 2093979 | 9/1982 | United Kingdom | 110/265 |

*Primary Examiner*—Margaret A. Focarino
*Attorney, Agent, or Firm*—Troxell K. Snyder

[57] ABSTRACT

A coal and char burner (10) is formed of three concentric cylinders (14,16,18). The central passage (32) conveys char particles into the interior (20) of a coal gasifier. Fresh coal and secondary air enter the gasifier through concentric passageways (24,27) surrounding the central passageway (32). The coal and air form a high temperature reaction envelope (30) which surrounds the char stream (22) and rapidly heats the char particles.

1 Claim, 3 Drawing Figures

COAL AND CHAR BURNER

FIELD OF THE INVENTION

The present application provides a method and an apparatus for firing coal and char with air and, more particularly, a method and an apparatus for firing coal and char with air in a slagging coal gasifier to facilitate the removal of the inert ash compounds.

BACKGROUND OF THE INVENTION

One problem which occurs in a great number of coal gasification systems, in particular atmospheric entrained flow gasification systems, is the difficultly experienced when attempting to recycle char back into the gasification vessel for further reaction. Char, as defined herein, is a particulate compound consisting of carbon and inert ash which results from incomplete gasification of the fresh feed coal in the coal gasifier vessel. This char, consisting of approximately 50% carbon and 50% ash, must be recycled back into the gasification vessel for further reaction to maintain system efficiency at an acceptable level.

In a two stage entrained flow gasifier, the first or slagging stage fires fresh coal and char with an oxidant stream, such as air, to not only provide the heat required to drive the gasification reaction in the second stage, but also to remove the inert ash compounds present in the coal as a liquid slag which may be drained from the first stage by gravity and solidified in a cooling tank located below the first stage. This first stage is usually operated under substoichiometric conditions with temperatures in the range of (1371 to 1927 C.) in order to maintain the slag in a liquid state.

The above mentioned problem arises due to the relatively low reactivity of the char being fed to the first stage when compared to the reactivity of the frsh coal feed. Fresh coal includes only a small portion of inert ash (generally no more than 10% by weight) and a volatile fraction of reactable hydrocarbons. Char, on the other hand, typically has five times the relative amount of inert material and no reactable hydrocarbons or volatile matter. It is thus common for the recycled char to not react effectively in the first stage of the coal gasifier vessel causing a large amount of unreacted material to enter the second or gasification stage. This large char recycle rate results in overloading of the down stream particulate removal and recycle feed equipment and can severely penalize system efficiency. Moreover, insufficiently heated char ash not leaving the first stage can become viscous and cause plugging of the slag tap, necessitating shutdown of the gasifier.

What is needed is a simple, effective means for inducing the char to react with oxygen present to form carbon monoxide product gas and to cause liquefaction of the ash component of the char in order to facilitate the removal of slag from the first stage.

SUMMARY OF THE INVENTION

The present invention provides a method and an apparatus for firing coal and char with air in a slagging coal gasifier such that the char is rapidly heated to a sufficient temperature to liquify the inert ash compounds present in the char and to encourage the reaction of the char carbon component with other reactants present in the gasifier to form a product gas.

According to the present invention, char, coal, and air are injected concentrically with the char forming a center stream, air forming an outermost concentric annular stream, and coal forming an annular stream intermediate the char and air streams. This configuration results in an annular shaped reaction envelope of coal and air surrounding the char stream. The heat released in the reaction envelope causes rapid heating of the char stream facilitating the liquefaction of the inert ash compounds and rapid reaction of the char carbon component.

The concentric injection may be achieved by means of three concentric cylinders which pass into the interior of the gasification vessel in the slagging region. Char is transported through the innermost cylinder, preferably by air in a dense phase relationship. Coal is transported through the annular space formed between the innermost cylinder and the next innermost cylinder, preferably by air in a dilute phase relationship. Air is transported through the annular passage formed between the outermost and next outermost cylinders.

DESCRIPTION OF THE PREFERRED EMBODIMENT

Figure 1:
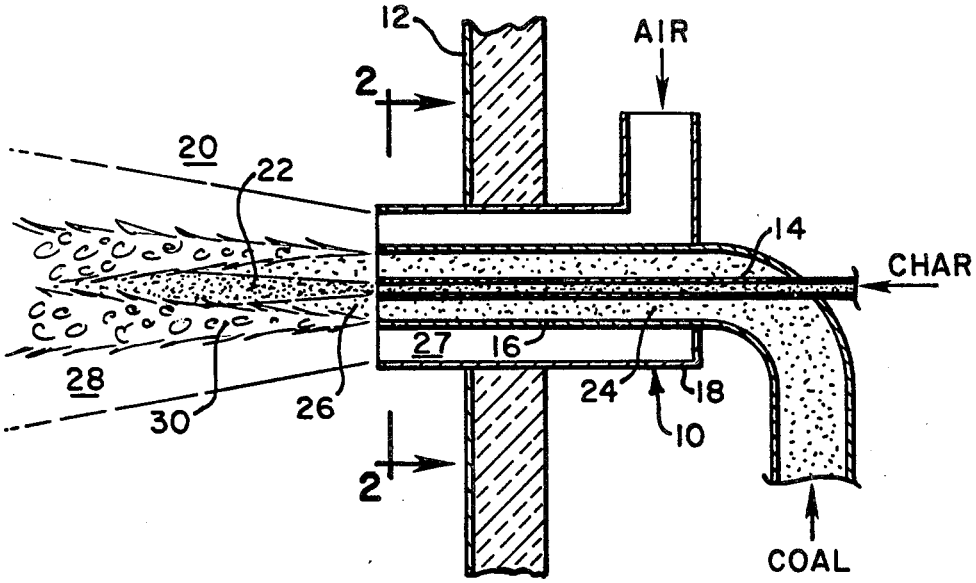
FIG. 1 shows a side elevation of the burner as installed in a coal gasifier vessel.

Referring now the appended drawings, FIG. 1 shows the burner according to the present invention installed in the wall 12 of a coal gasifier vessel (not shown). The burner 10 is preferably made up of three concentric cylinders 14,16,18 which pass through the gasifier vessel wall 12 and terminate openly within a gasifier vessel interior 20.

During operation, recycled char is fed to the innermost cylinder 14 for injection into the coal gasifier vessel. This char, collected by downstream particulate removal means (not shown), consists primarily of a carbon component and an inert ash component. Although the carbon to ash ratio in the char is typically one to one, the actual ratio may range from 0.1 to 10, depending on current gasifier operating conditions.

The char is preferably conveyed by a conveying gas, such a air, in a dense phase flow relationship. In dense phase flow, the mass flow ratio of the solid being conveyed and the conveying gas is typically 10 to 1. The transport of the char into the gasifier vessel in this manner produces a dense, narrow stream of char particles 22 exiting the end of the innermost cylinder 14 of the burner 10.

The fresh coal for gasification enters the gasifier vessel through the annular passageway 24 formed between the innermost cylinder 14 and the next innermost cylinder 16. Fresh coal typically consists of an ash component, typically 10% by weight, a fixed carbon component, typically in the range of 40 to 60% by weight, and a volatile component, typically in the range of 50 to 20% by weight. The volatile component of the coal consists of combustible hydrocarbons. In the coal gasification process, the injection of the coal into the operating combustor results in rapid devolatilization. The gaseous volatiles quickly react exothermically with any available oxygen to form oxides of carbon and water vapor.

The heat thus generated by this exothermic reaction is short lived as there is typically an abundance of unreacted carbon present in the gasifier vessel. This carbon reacts endothermically with the carbon dioxide and water vapor to form the products of gasification, carbon monoxide and hydrogen. This gasification reaction is relatively slow compared to the devolatilization/combustion reaction described above thus resulting in a diminishing reaction mixture temperature with increasing time.

It is an important part of the function of a slagging gasifier to provide an environment in which a significant fraction of the inert ash components present within the gasifier vessel may be heated to their melting point, contact the vessel wall 12, and be slagged out of the gasifier vessel. Inability to slag out a significant fraction of the inert ash material will result in an excessive loading of inert ash in the downstream particulate removal equipment.

To facilitate the devolatilization/combustion reaction of the fresh coal in the gasifier vessel, the fresh coal is transported through the annular passageway 24 by air or other oxidant in a dilute phase flow relationship. In dilute phase flow, the mass flow of the conveying gas at least about 1.5, preferably in the range of 1.5 to 1.7, times greater than the mass flow of the conveyed solid material. In the preferred embodiment, the transport air and coal mix thoroughly while flowing to the burner as well as in the annular passageway 24 before entering the gasifier vessel interior 20 as an annular stream 26.

Additional air required in the gasification process enters the gasifier vessel through the annular passageway 27 formed between the outermost concentric cylinder 18 and the next outermost concentric cylinder 16. The amount of air thus entering the gasifier vessel is determined by a variety of considerations such as coal analysis, gasifier system design, and desired final product gas heating value. This extra air, often termed secondary air, enters the gasifier vessel interior 20 as an annular stream 28.

Upon entering the gasifier vessel interior 20, the annular coal stream 26 is heated by radiation from the surrounding walls. This heating results in devolatilization of the fresh coal and an exothermic combustion reaction between the devolatilized hydrocarbons and the conveying primary air. As the coal stream 26 moves further into the vessel interior 20 it begins to mix with the annular secondary air stream 28 resulting in further combustion of the devolatilized hydrocarbons as well as at least some combustion of the coal fixed carbon. The reactions involving coal discussed thus far have been highly exothermic and serve to create an annular reaction envelope 30 which surrounds the dense char stream 22. The temperature of this reaction envelope is quite high, in the range of 2800 to 3500 F. and results in rapid radiative and conductive heating of the char stream 22. The char stream 22 is heated above the ash melting point, approximately 2800 F., thus encouraging the deposition of the now liquid slag on the walls 12 of the gasifier vessel.

Another benefit achieved by the rapid heating of the char stream is the increased reaction rate of the char carbon component with the gaseous reactants present in the gasifier vessel interior 20. By encouraging complete and rapid reaction of the char component in the gasifier vessel, the coal and char burner according to the present invention serves to increase gasifier vessel capacity and efficiency of conversion.

Without the surrounding high temperature reaction envelope of coal and air, the char would be slowly heated by the surrounding gasifier walls and reactants which would typically be at the average gasifier vessel interior temperature. It is the utilization of the local high temperature reaction zone which occurs at the initial mixing point of fresh coal and air that results in the rapid and effective heatup of the char stream. Insufficiently heated char is relatively unreactive in the gasification vessel and cannot be effectively slagged.

By using dense phase transport for the char stream, the char may be injected into the center of the concentric coal and secondary air streams 26,28 without substantially disrupting the stream flow paths. The use of dense phase char transport also shifts a larger percentage of the total gasifier air mass flow into the secondary air stream for a particular gasifier overall stoichiometry. This not only results in a higher local coal air stoichiometry in the reaction zone 30, but also allows greater flexibility in the control of gasifier stoichiometry during all phases of operation.

Figure 2:
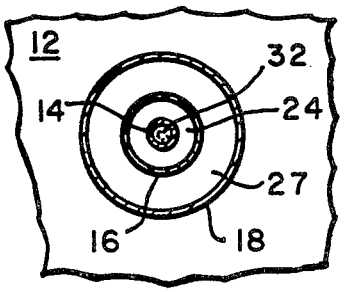
FIG. 2 shows a cross-sectional view of the burner.

FIG. 2 shows a cross-sectional view of the apparatus according to the present invention as installed in the wall 12 of a gasifier vessel. The central passageway 32 as well as the concentric annular passageways 24,27 formed by the three concentric cylinders 14,16,18 are shown.

Figure 3:
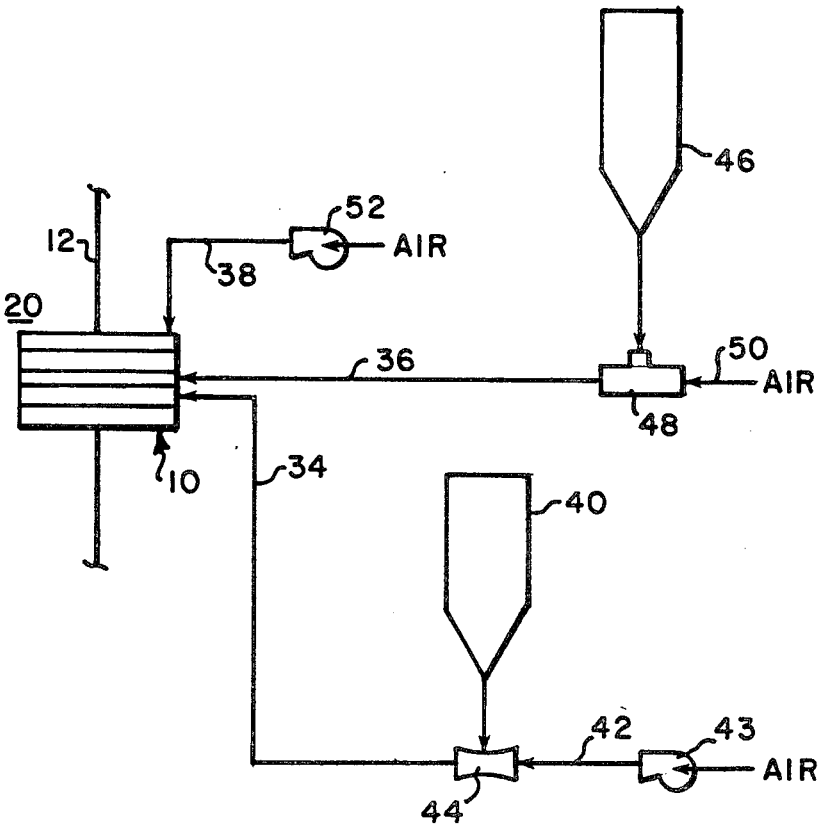
FIG. 3 shows a schematic arrangement of coal, char, and air supplying equipment.

FIG. 3 shows a schematic arrangement of the equipment for supplying char, coal, and air to the coal and char burner 10. The illustrated equipment is just one arrangement well known in the art for supplying solid fuels to a gasifier or furnace and is disclosed here only for illustrative purposes.

The burner 10 and gasifier vessel wall 12 are shown schematically with coal, char, and air streams 34,36,38 entering the burners via conduits (not shown) or other suitable means. Pulverized coal is transported from a source, such as a coal bin 40, by mixing the coal with coal transport air supplied by a blower 43 in a venturi pickup 44. The result is a stream 34 of coal and transport air in a dilute phase relationship as discussed above.

Char from the char collection bin 46 enters a solids pump 48 along with compressed air 50. Solids pumps are known in the art and available from several manufacturers. The output 36 of the solids pump 48 is a stream of char and air in a dense phase relationship as discussed above.

Additional air is supplied to the burner 10 via a conduit 38 from fan 52. The amount of air supplied depends on the particular operating parameters and design of the gasifier but is generally sufficient, when combined with the coal and char transport air, to provide an overall gasifier stoichiometry of 50 to 60%.

The present invention thus provides a method for firing coal and char with an oxidant such as air in a slagging coal gasifier vessel which effectively heats the char to a sufficient temperature for enhanced slagging and carbon reaction. This enhanced slagging and increased carbon reaction results in not only diminished downstream particulate removal capacity, but also in increased gasifier system efficiency and operability. These and other advantages will be apparent to one skilled in the art upon examination of the foregoing specification and the appended drawing figures.

I claim:

1. A method for firing coal and char with air under substoichiometric conditions in a slagging coal gasifier vessel, comprising the steps of:

feeding said char into said vessel as a central stream of char and air, the mass flow rate of the air in the central stream being approximately 0.1 times the mass flow rate of the char in the central stream;

feeding said coal into said vessel as a first annular stream of coal and air immediately surrounding the central stream, the mass flow rate of the air in the first annular stream being approximately 1.5 times the mass flow rate of the coal in the first annular stream; and feeding any remaining air necessary for the gasification process into the vessel as a second annular stream surrounding both the central stream and the first annular stream for forming an annular exothermic reaction envelope of coal and air surrounding the char stream.

* * * * *